US006386822B1

(12) United States Patent
Burr

(10) Patent No.: US 6,386,822 B1
(45) Date of Patent: May 14, 2002

(54) SIDE DUMP COUPLER ASSEMBLY

(75) Inventor: Matthew P. Burr, Apex, NC (US)

(73) Assignee: Caterpillar S.A.R.L., Geneva (CH)

( * ) Notice: Subject to any disclaimer, the term of this patent is extended or adjusted under 35 U.S.C. 154(b) by 0 days.

(21) Appl. No.: 09/461,842

(22) Filed: Dec. 15, 1999

(51) Int. Cl.[7] ..... E02F 3/36
(52) U.S. Cl. ..... 414/723; 414/726; 37/468
(58) Field of Search ..... 414/722, 723, 414/725, 726; 37/468; 172/811, 818

(56) References Cited

U.S. PATENT DOCUMENTS

| | | | | |
|---|---|---|---|---|
| 3,203,565 A | * | 8/1965 | Keskitalo | 414/722 X |
| 3,400,845 A | | 9/1968 | Salna | |
| 3,583,589 A | | 6/1971 | Leijon | |
| 3,738,513 A | | 6/1973 | Wagner | |
| 3,885,694 A | * | 5/1975 | Uchida et al. | 414/722 X |
| 4,220,438 A | | 9/1980 | Anderson, Jr. | |
| 4,307,992 A | | 12/1981 | Robnett | |
| 4,341,026 A | | 7/1982 | Uchida et al. | |
| 5,098,252 A | * | 3/1992 | Sheesley et al. | 414/723 |
| 5,141,288 A | | 8/1992 | Smith | |

* cited by examiner

*Primary Examiner*—Donald W. Underwood
(74) *Attorney, Agent, or Firm*—Diana L. Charlton

(57) ABSTRACT

The present invention includes a coupler assembly connected between a standard bucket and a work machine. The coupler assembly converts the standard bucket to a side dump bucket. The conversion is possible through the use of a pivot assembly and actuating device. The pivot assembly includes an interface portion that is releasably connected to the work machine and a base portion. The base portion is pivotably and releasably connected with the interface portion via pins. The actuating device is connected between the interface portion and the base portion. The removal of one of the pins allows for the pivotable movement of the base portion outwardly and laterally via the actuating device to establish an angular relationship between the bucket and the work machine for dumping material within the bucket to one side of the work machine. Additionally, the coupler assembly is designed so that the actuating device may be easily relocated so that pivotable movement of the base portion allows material within the bucket to be dumped to another side of the work machine opposite the one side.

10 Claims, 6 Drawing Sheets

SIDE DUMP COUPLER ASSEMBLY

TECHNICAL FIELD

This invention relates generally to the ability to side dump a bucket connected to a work machine and more particularly to a coupler assembly connected on the work machine that converts a standard bucket to a side dump bucket.

BACKGROUND ART

Present work machines, such as skid steer loaders and the like, utilize various attachments, such as buckets. During certain operations, it is advantageous to have a bucket that has side dump capabilities so that materials within the bucket may be conveniently unloaded at one side of the work machine.

Conventionally, the side dump capability is accomplished through the use of a side dump bucket. One or more cylinders is typically attached in a predetermined manner to the side dump bucket in order to facilitate this function. In operation, the side dump bucket is raised and the cylinders are actuated to angle the bucket laterally. The side dump bucket is unloaded in a well-known manner by rotating the bucket a sufficient amount, via the dump cycle of the work machine, causing the load to slide out of the bucket by gravity. Unfortunately, the side dump structure is connected directly to the bucket. Therefore, in order to achieve the side dump capability, a side dump bucket must be available on a work site. This may require that an operator purchase standard buckets and side dump buckets of varying sizes in order to fulfill all the work site requirements. Further, the utilization of the various buckets may necessitate continuous decoupling and coupling of the various attachments dependent on the bucket desired. Also, because side dump buckets typically dump to only one side of the work machine, it may be necessary to purchase separate side dump buckets that allow dumping to both sides of the work machine. For these and other reasons, the ability to convert a standard bucket to a side dump bucket simply and conveniently is useful on the work site to increase operator efficiency and reduce time, energy and costs.

The present invention is directed to overcoming the problems as set forth above.

DISCLOSURE OF THE INVENTION

In one aspect of the present invention, a coupler assembly is adapted for pivotably coupling a bucket attachment to a work machine having a longitudinal axis. The coupler assembly comprises a coupling mechanism connectable with the bucket attachment. A pivot assembly is disclosed that includes an interface portion and a base portion. The interface portion is connectable with the work machine. The base portion is fixedly connected with the coupling mechanism and pivotably and releasably connected with the interface portion to define a pivot axis. The interface portion is substantially parallel with the bucket attachment. An actuating device is disposed between the interface portion and the base portion. The actuating device is movable between first and second positions for laterally outwardly pivoting the base portion about the pivot axis so that an angular relationship is established between the interface portion and the bucket attachment.

In another aspect of the present invention, a method is disclosed for converting a standard bucket attachment for a work machine having a longitudinal axis to a side dump bucket attachment. The method comprises the steps of first providing a standard bucket attachment. Then, connecting a coupler assembly between the standard bucket attachment and the work machine. The coupler assembly includes a coupling mechanism releasably connected with the standard bucket attachment, an interface portion and a base portion. The interface portion is releasably connected with the work machine. The base portion is fixedly connected with the coupling mechanism and pivotably and releasably connected with the interface portion to define a pivot axis. Finally, moving an actuating device connected between the interface portion and the base portion from a first position to a second position for laterally outwardly pivoting the base portion about the pivot axis so that an angular relationship is established between the interface portion and the bucket attachment in order to dump material therein to one side of the work machine.

The present invention includes a coupler assembly connected between a standard bucket attachment and a work machine. The coupler assembly converts the standard bucket attachment to a side dump attachment. This conversion capability increases flexibility on a work site in that a standard bucket attachment may be used to dump material to one side of the work machine. The ability to utilize a standard bucket attachment in this way eliminates the need to decouple and recouple a separate side dump bucket attachment. The coupler assembly is simply designed for easy use. Therefore, efficiency is increased and time, energy and costs are reduced.

BEST MODE FOR CARRYING OUT THE INVENTION

Figure 1:
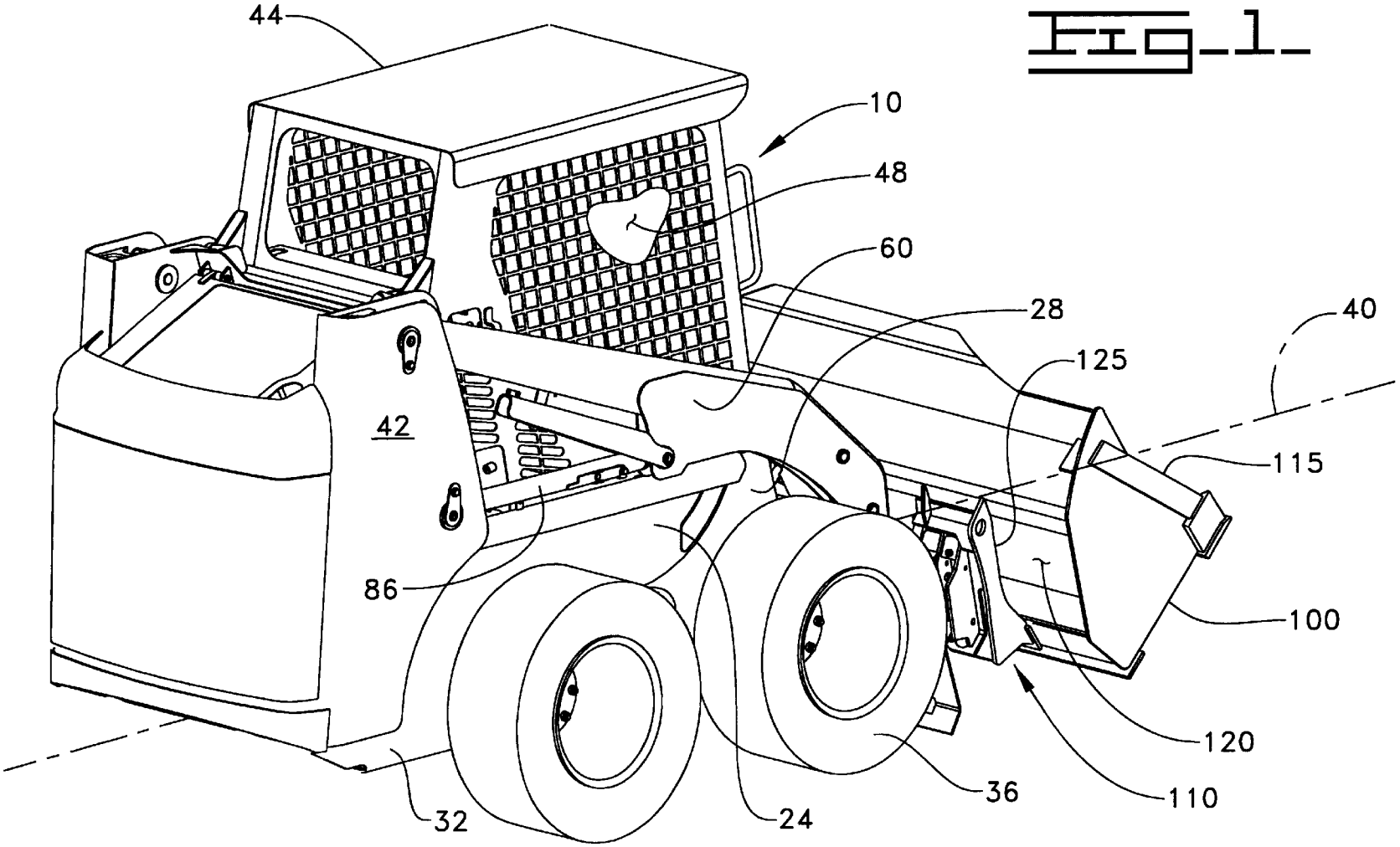
FIG. 1 is a perspective view of a work machine incorporating a present invention coupler assembly.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring to FIG. 1, a work machine 10, such as a skid steer loader, is shown incorporating the present invention. The work machine 10 includes a frame 24 with front and rear end portions 28,32 supported by a plurality of wheels 36. An axis 40 extends longitudinally through the frame 24 of the work machine 10. The frame 24 includes left and right upright tower assemblies, one of which is shown at 42, that are positioned on the rear end portion 32 thereof. A cab 44 is mounted on the frame 24 for partially enclosing an operator (not shown) within an operating compartment 48. Left and right liftarm assemblies, one of which is shown at 60, are pivotally mounted to the respective corresponding left and right tower assemblies 42 for movement between lowered and raised positions. A pair of any suitable type of lift actuators, one of which is shown at 86, are used to lower and raise the liftarm assemblies 60.

An attachment, such as a bucket 100, is connected to the frame 24 of the work machine 10 through a coupler assembly 110 attached to the liftarm assemblies 60. It should be understood that the bucket 100 is of standard design and may be of any size and load capability. The bucket includes front and rear portions 115, 120. Spaced coupling structure 125 of well known design is connected at the rear portion 120 of the bucket 100.

Figure 2:
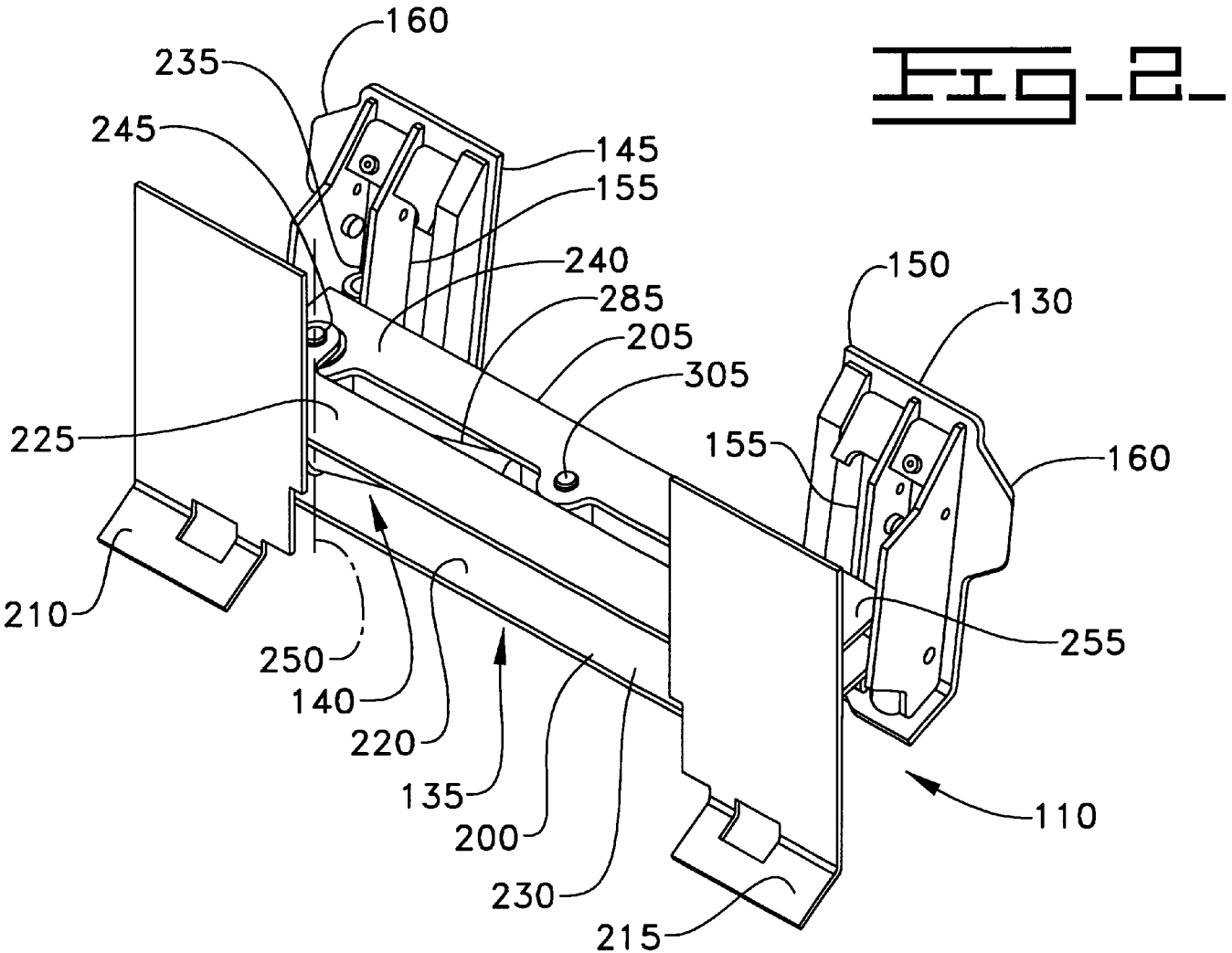
FIG. 2 is a perspective view of the present invention coupler assembly for a work machine.
Figure 3:
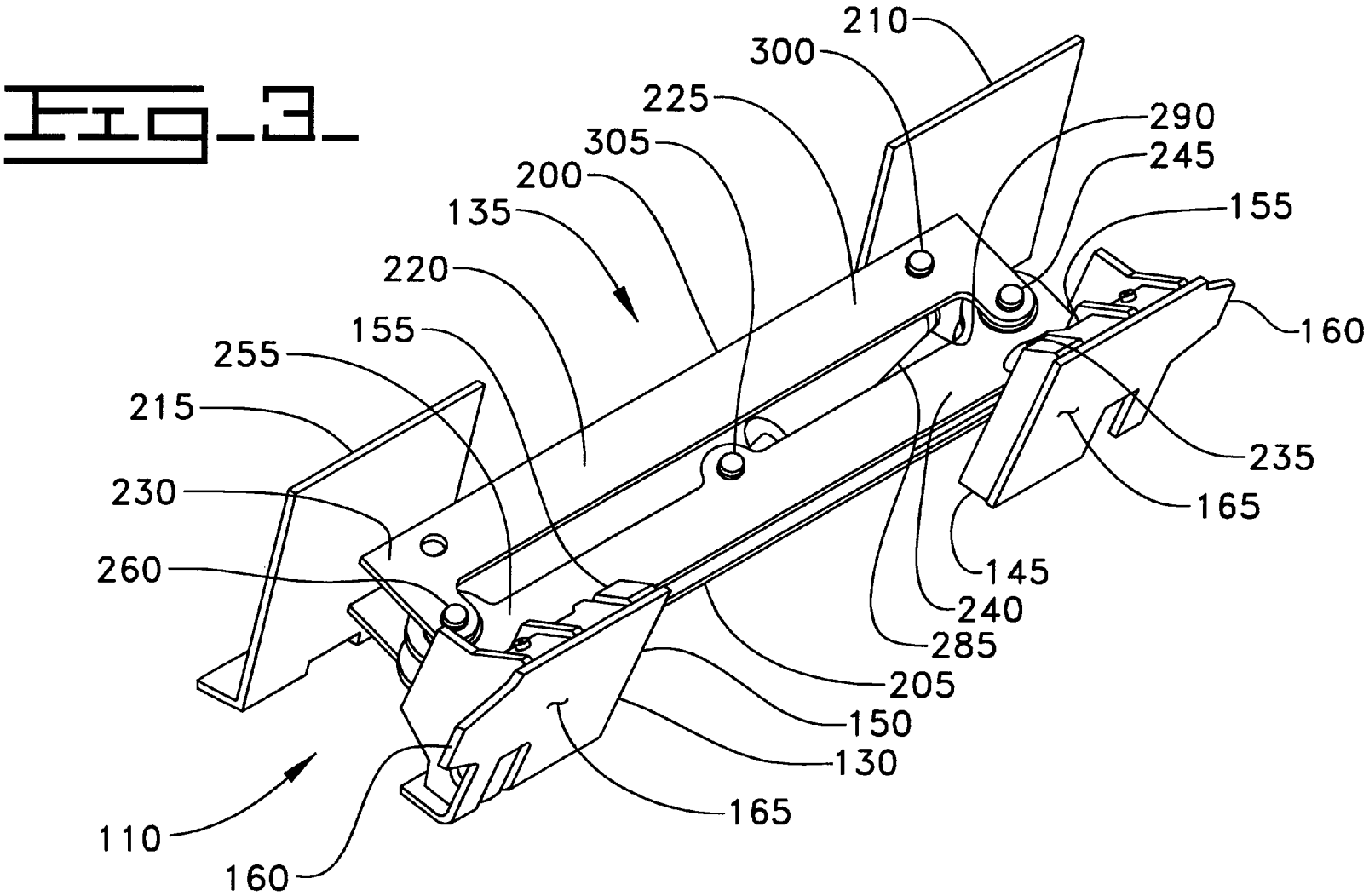
FIG. 3 is a perspective view of the present invention coupler assembly at an opposite direction from that of FIG. 1.

As seen throughout most of the drawings, but more particularly in FIGS. 2 and 3, the coupler assembly 110 includes a coupling mechanism 130, a pivot assembly 135 and an actuating device 140.

The coupling mechanism 130 consists of a pair of spaced couplers 145, 150 that each include a housing portion 155 with a vertical engagement device (not shown) disposed therein. A vertical plate portion 160 is fixedly connected to the housing portion 155 to define therewith a planar front surface 165. It should be understood that any coupling mechanism could be used to attach the coupler assembly 110 to the bucket 100 without deviating from the scope of the present invention.

The pivot assembly 135 includes an interface portion 200 and a base portion 205. The interface portion 200 includes a pair of spaced interface plates 210, 215 connected by a bar 220 extending therebetween. The bar 220 has a first end portion 225 and a second end portion 230 opposite the first end portion 225. The base portion 205 is fixedly connected to a rear surface 235 of the coupling mechanism 130 and extends across the space between the couplers 145, 150. The base portion 205 has a pivot end 240 that is pivotably and releasably connected with the interface portion 200 via a conventional pin 245 to define a pivot axis 250. The pivot axis 250 is located at one side of the longitudinal axis 40 of the work machine 10. The base portion 205 has a stationary end 255 opposite the pivot end 240 that is pivotably and releasably connected with the interface portion 200 via a pin 260 to fix the bar 220 of the interface portion 200 and lock the pivot assembly 135.

Figure 4:
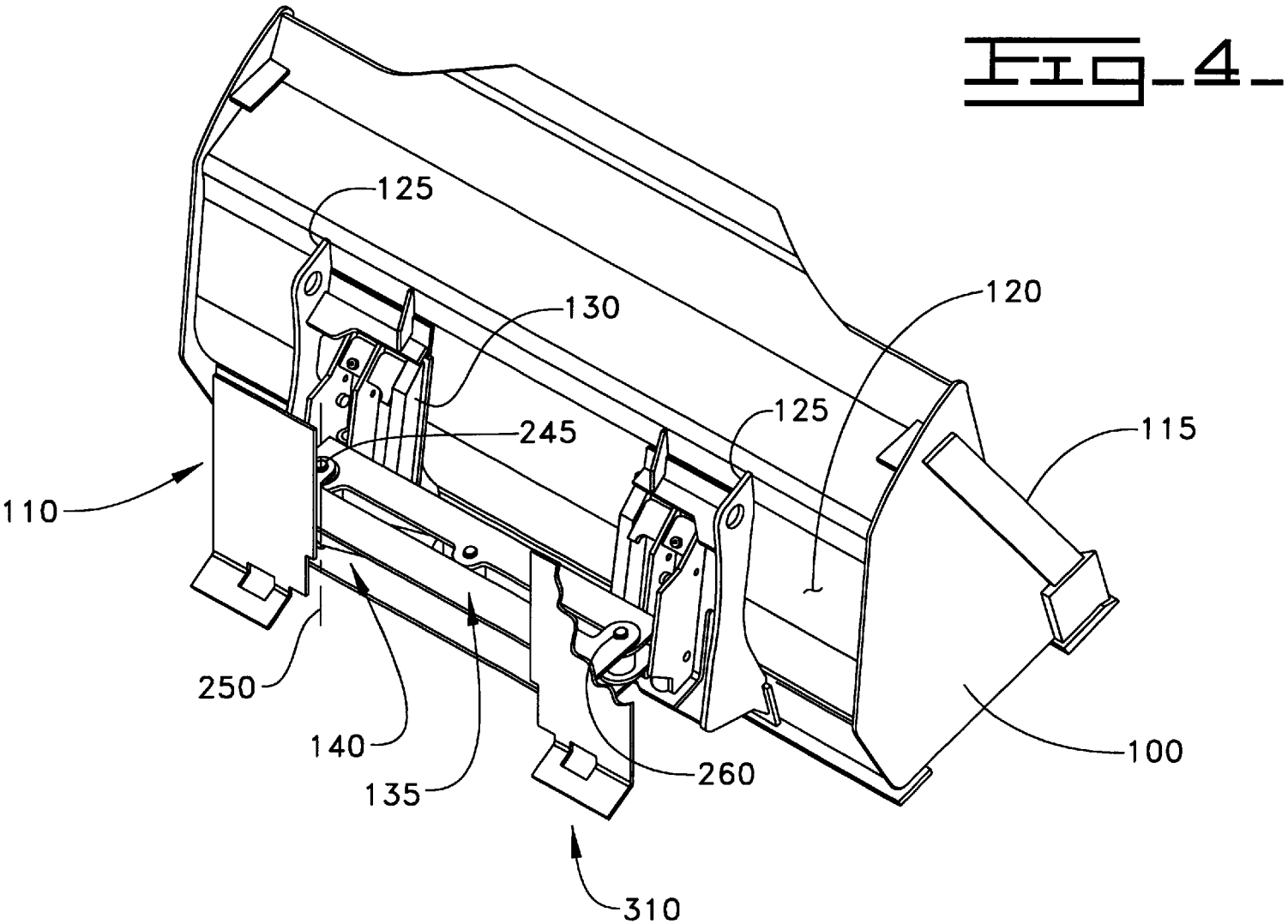
FIG. 4 is a perspective view of the present invention coupler assembly connected on a standard bucket.
Figure 5:
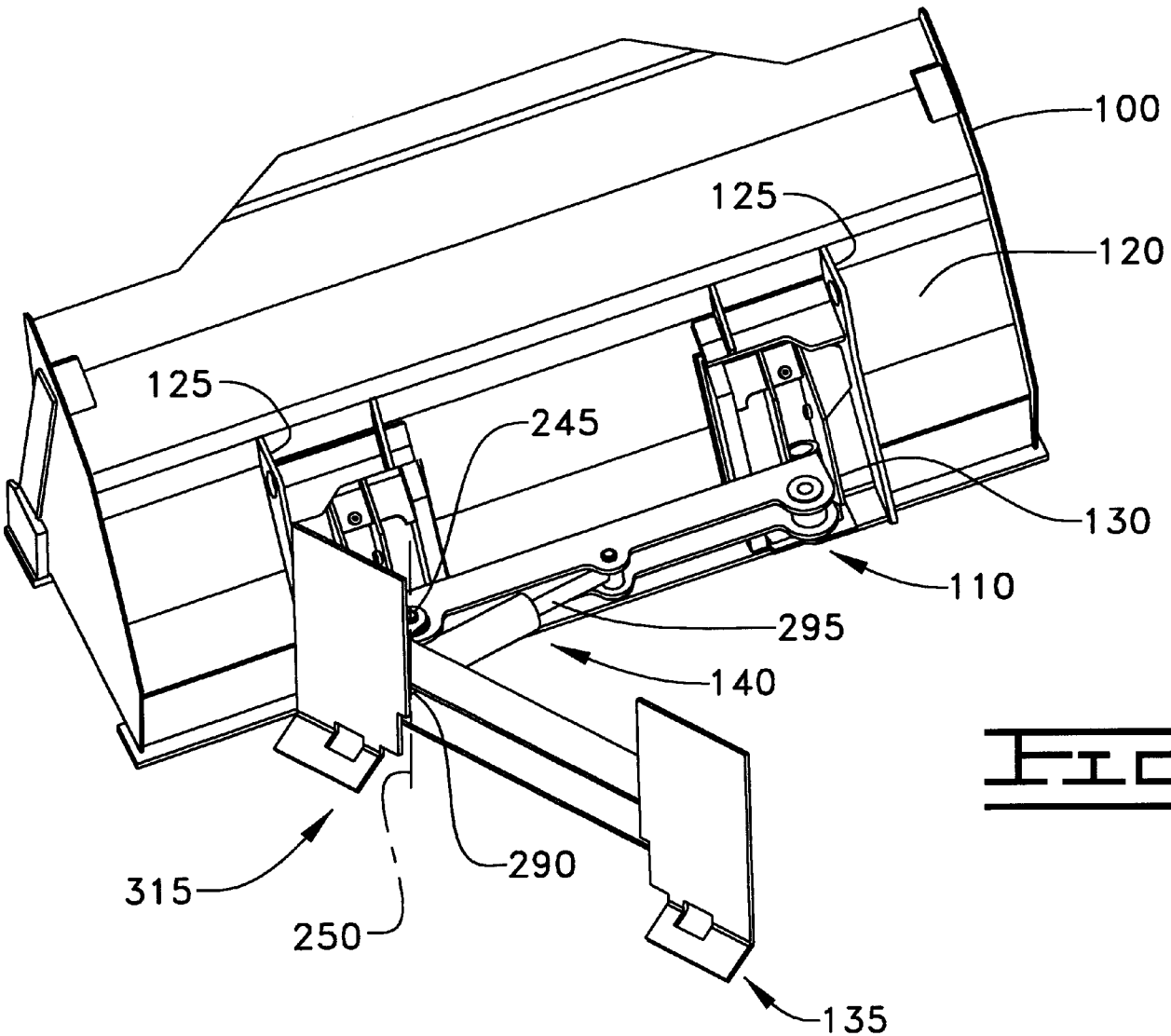
FIG. 5 is a perspective view of the present invention coupler assembly converting the standard bucket to a side dump bucket for dumping on one side of the work machine.
Figure 6:
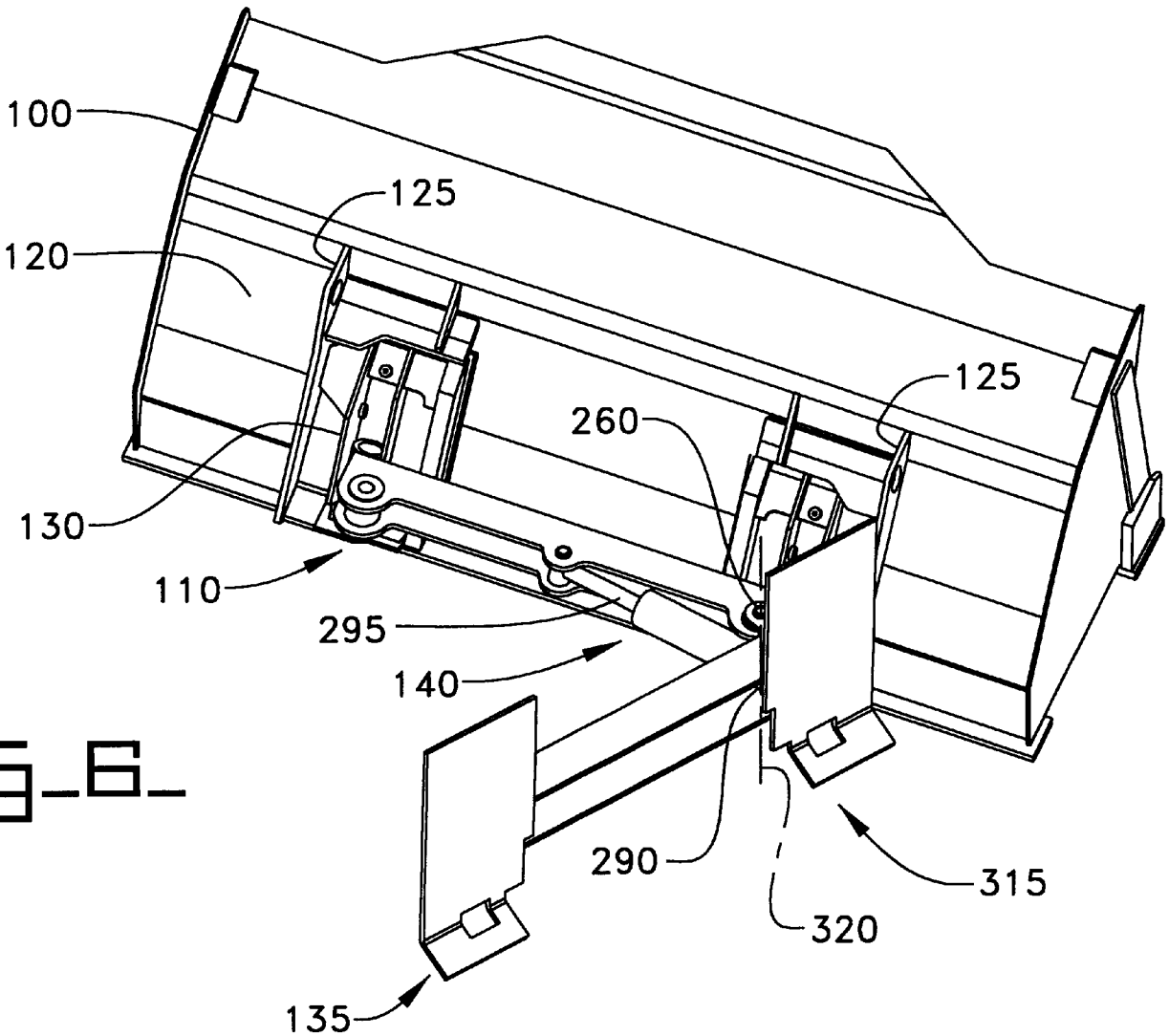
FIG. 6 is a perspective view of the present invention coupler assembly converting the standard bucket to a side dump bucket for dumping on another side of the work machine opposite the one side.

The actuating device 140 includes a conventional hydraulic cylinder 285 with head and rod ends 290,295, seem more clearly in FIGS. 5–6. Referring again more specifically to FIGS. 2–3, the head end 290 is pivotably and releasably connected via a pin 300 to the first end 225 of the interface portion 200 adjacent the pivot axis 250. The rod end 295 is fixably connected via a pin 305 to the base portion 205 at substantially a central location located between the pivot end 240 and the stationary end 255. The rod end 295 is movable between non-actuated and actuated positions 310, 315 as is well known, as seen respectively in FIGS. 4–5. Although a conventional hydraulic cylinder 285 is shown, it should be understood that any actuating device may be utilized in place of the hydraulic cylinder 285 and still be within the scope of the present invention.

INDUSTRIAL APPLICABILITY

In order to convert a standard bucket 100 for a work machine 10 to a side dump bucket, the interface plates 210, 215 are releasably connected in a well known manner to the lift arms 60 of the work machine 10. Next, the planar front surfaces 165 of the couplers 145, 150 are releasably connected with the respective spaced coupling structure 125 at the rear portion 120 of the bucket 100 in a well known manner, as seen best in FIG. 1. The vertical engagement device (not shown) is used to retain the coupler assembly 110 on the bucket 100 via a conventional hydraulic pin system (not shown) so that the coupler assembly 110 is located between the work machine 10 and the bucket 100.

With the coupler assembly 110 in position between the work machine 10 and the bucket 100, the pins 245, 260 lock the pivot assembly 135 to maintain a substantially parallel relationship between the bar 220 of the interface portion 200 and the rear portion 120 of the bucket 100, as seen in FIG. 4. Of course, due to the connection between the interface portion 200 and the work machine 10, the substantially parallel relationship also exists between the work machine 10 and the bucket 100. When pin 260 is removed by an operator (not shown), the pivot assembly 135 is no longer locked and is capable of pivotable movement via the pin 245. To accomplish the pivotable movement, the rod end 295 of the hydraulic cylinder 285 is moved to the actuated position 315 that pivots the base portion 205 laterally outwardly about the pivot axis 250 to establish an angular relationship between the interface portion 200 and the bucket 100, as seen in FIG. 5. Again, it should be understood that the relationship between the interface portion 200 and the work machine 10 would also establish an angular relationship between the work machine 10 and the bucket 100. The location of the pivot axis 250 on one side of the longitudinal axis 40 of the work machine 10, ensures that the front portion 115 of the bucket 100 faces outwardly so that material therein may be dumped to one side of the work machine 10 via operator (not shown) control. Once the dumping is complete, the rod end 295 of the hydraulic cylinder 285 is moved to the non-actuated position 310, pivoting the base portion 205 laterally inwardly about the pivot axis 250 until the pin 260 may be reinserted to lock the pivot assembly 135, as again seen in FIG. 4.

If it is desired to dump material to the opposite side of the work machine 10, the coupler assembly 110 may be easily converted to accommodate this function. Pin 245 may be removed to define a second pivot axis 320 at pin 260 disposed at the stationary end 255 of the base portion 205. Next, pin 300 is removed and relocated for pivotably and releasably connecting the head end 290 of the hydraulic cylinder 285 to the second end portion 230 of the bar 220 of the interface portion 200 adjacent the second pivot axis 320. To pivot the pivot assembly 135, the rod end 295 of the hydraulic cylinder 285 is moved to the actuated position 315 that pivots the base portion 205 laterally outwardly about the second pivot axis 320 to establish an angular relationship between the interface portion 200 and the bucket 100, as seen in FIG. 6. The location of the second pivot axis 320 on the opposite side of the longitudinal axis 40 of the work machine 10 from that described above, ensures that the front portion 115 of the bucket 100 faces outwardly so that material therein may be dumped to the opposite side of the work machine 10 via operator (not shown) control. Once the dumping is complete, the rod end 295 of the hydraulic cylinder 285 is moved to the non-actuated position 310, pivoting the base portion 205 laterally inwardly about the second pivot axis 320 until the pin 245 may be reinserted to lock the pivot assembly 135.

The ability to convert a standard bucket 100 to a side dump bucket increases flexibility on a work site in that a standard bucket 100 may be used to dump material to either side of the work machine. The ability to utilize a standard bucket 100 in this way eliminates the need to purchase a specific side dump bucket. Further, this design reduces any time and energy in attaching the side dump bucket because only one standard bucket 100 is necessary. The coupler assembly is simply designed for easy use by an operator. Therefore, reduction of time, energy and costs is achieved with increased operator efficiency.

Other aspects, objects and advantages of this invention can be obtained from a study of the drawings, disclosure and the appended claims.

What is claimed is:

1. A coupler assembly adapted for pivotably coupling a bucket attachment to a work machine having a longitudinal axis, the coupler assembly comprising:

a coupling mechanism connectable with the bucket attachment;

a pivot assembly including an interface portion connectable with the work machine and a base portion fixedly connected with the coupling mechanism and pivotably and releasably connected with the interface portion to define a pivot axis, the interface portion being substantially parallel with the bucket attachment; and an actuating device disposed between the interface portion and the base portion, the actuating device movable between first and second positions for laterally outwardly pivoting the base portion about the pivot axis so that an angular relationship is established between the interface portion and the bucket attachment.

2. The coupler assembly of claim 1, wherein the pivotable and releasable connection between the base portion and the interface portion is located at a pivot end of the base portion, the base portion being pivotably and releasably connected to the interface portion at a stationary end opposite the pivot end to restrict the pivoting of the base portion.

3. The coupler assembly of claim 1, wherein the pivot axis is positionable on one side of the longitudinal axis of the work machine.

4. The coupler assembly of claim 1, wherein the coupler mechanism includes a pair of spaced couplers, each of the couplers being connected at a rear surface to the base portion and having a housing and a vertical plate fixedly connected to the housing to define therewith a planar front surface.

5. The coupler assembly of claim 2, wherein the actuating device is a hydraulic cylinder having rod and head ends, the rod end being connected to the base portion between the pivot end and stationary end and the head end being pivotably and releasably connected to a first end of the interface portion adjacent the pivot axis.

6. A method of converting a standard bucket attachment for a work machine having a longitudinal axis to a side dump bucket attachment, comprising the steps of:

providing a standard bucket attachment;

connecting a coupler assembly between the standard bucket attachment and the work machine, the coupler assembly including a coupling mechanism releasably connected with the standard bucket attachment, an interface portion releasably connected with the work machine and a base portion fixedly connected with the coupling mechanism and pivotably and releasably connected with the interface portion to define a pivot axis; and moving an actuating device connected between the interface portion and the base portion from a first position to a second position for laterally outwardly pivoting the base portion about the pivot axis so that an angular relationship is established between the interface portion and the bucket attachment in order to dump material therein to one side of the work machine.

7. The method of converting a standard bucket attachment to a side dump bucket attachment of claim 6, including the steps of:

pivotably and releasably connecting the base portion and the interface portion at a pivot end of the base portion;

pivotably and releasably connecting the base portion to the interface portion at a stationary end opposite the pivot end to restrict the pivoting of the base portion.

8. The method of converting a standard bucket attachment to a side dump bucket attachment of claim 6, including the step of:

positioning the pivot axis on one side of the longitudinal axis of the work machine.

9. The method of converting a standard bucket attachment to a side dump bucket attachment of claim 7, including the steps of:

utilizing a hydraulic cylinder with rod and head ends as the actuating device;

connecting the rod end to the base portion between the pivot end and stationary end;

pivotably and releasably connecting the head end to a first end of the interface portion adjacent the pivot axis.

10. The method of converting a standard bucket attachment to a side dump bucket attachment of claim 9, including the steps of:

releasing the connection between the base portion and the interface portion at the pivot end of the base portion to define a second pivot axis at the pivotable and releasable connection between the stationary end of the base portion and the interface portion;

releasing the connection between the head end of the hydraulic cylinder and the first end of the interface portion;

pivotably and releasably connecting the head end of the hydraulic cylinder to a second end of the interface portion adjacent the second pivot axis; and moving the hydraulic cylinder from the first position to the second position for laterally outwardly pivoting the base portion about the second pivot axis so that an angular relationship is established between the interface portion and the bucket attachment in order to dump material therein to another side of the work machine opposite the one side.

* * * * *